United States Patent [19]

Ilmoni et al.

[11] 4,134,944

[45] Jan. 16, 1979

[54] PELLET-ROLLING METHOD

[75] Inventors: Pehr-Adrian Ilmoni, Enebyberg; Roland Drugge, Malmberget, both of Sweden

[73] Assignee: Luossavaara-Kiirunavaara AB, Stockholm, Sweden

[21] Appl. No.: 800,278

[22] Filed: May 25, 1977

[30] Foreign Application Priority Data

Jun. 2, 1976 [SE] Sweden ..... 7606241

[51] Int. Cl.[2] ..... B01J 2/12

[52] U.S. Cl. ..... 264/37; 264/117; 425/222; 425/332

[58] Field of Search ..... 264/117, 37; 425/222, 425/332

[56] References Cited

U.S. PATENT DOCUMENTS

| | | | |
|---|---|---|---|
| 3,140,326 | 7/1964 | Erck et al. | 264/117 |
| 3,433,859 | 3/1969 | Ban | 264/37 |
| 3,536,475 | 10/1970 | Trub | 264/117 |

*Primary Examiner*—Robert F. White

*Assistant Examiner*—James R. Hall

*Attorney, Agent, or Firm*—Fleit & Jacobson

[57] ABSTRACT

Pellets having uniform size and excellent strength properties are manufactured without fluctuations in production from finely-divided moist material by rolling nuclei of substantially mutually identical size in at least one pellet-rolling circuit in the presence of the finely-divided moist material, to form pellets having at least one layer of said material surrounding respective nuclei. A pre-determined quantity of the pellets formed during a rolling operation and comprising pellets which, during said rolling operation have obtained the largest diameter, is continuously removed as product pellets from said pellet-rolling circuit, while the remaining pellets formed during the rolling operation are returned to the rolling portion of the circuit for renewed rolling therein, the supply of finely divided moist material and of the nuclei to the pellet-rolling circuit being adjusted so that the diameter of the product pellets and the amount of material in the pellet-rolling circuit are maintained substantially constant.

14 Claims, 1 Drawing Figure

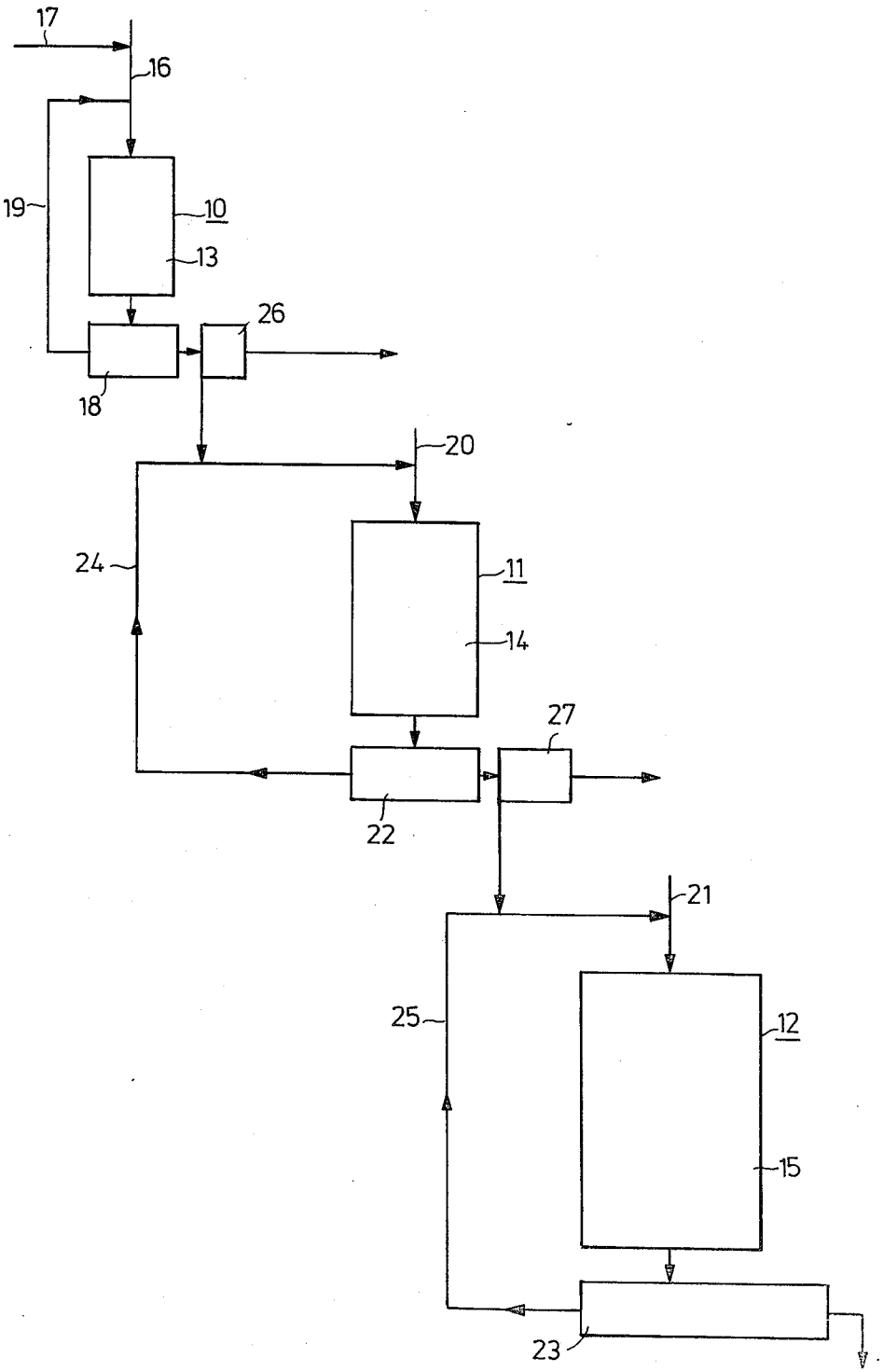
17
16
19
10
13
26
18
20
24
11
14
27
22
21
25
12
15
23

PELLET-ROLLING METHOD

The present invention relates to a method for producing pellets from finely-divided, moist material, particularly from iron ore concentrate, by rolling nuclei of substantially mutually identical size in at least one pellet-rolling circuit in the presence of said finely-divided, moist material, to form pellets having at least one layer of said material surrounding respective nuclei.

A serious disadvantage with conventional pellet-rolling processes applied on an industrial scale, resides in the fact that the mechanical-strength properties of the pellets produced are much poorer than those which can be achieved theoretically. The practical application of pellet-rolling processes also creates problems, mainly due to the fact that the flow of pellets from the known pellet-rolling apparatus fluctuates, creating difficulties in the subsequent process stages. Pellet production can be stabilized to a certain extent by, inter alia, increasing the amount of water added, although this will impair the green-strength and vary the size distribution of the pellets produced quite radically.

An object of the present invention is to provide a novel and useful pellet-rolling method in which the aforementioned disadvantages are substantially avoided.

To this end it is proposed according to the invention a pellet-rolling method of the type mentioned in the introduction, wherein a pre-determined substantially constant quantity of the pellets formed during a rolling operation, said quantity comprising pellets which during said rolling operation have obtained the largest diameter, is continuously removed as product pellets from said pellet-rolling circuit, while the remaining pellets are returned to the rolling portion of the circuit for renewed rolling therein, the supply of finely-divided moist material and of the nuclei to the pellet-rolling circuit being adjusted so that the size of the product pellets and the amount of material in the pellet-rolling circuit are maintained substantially constant. In this way a substantially constant supply of pellets of particularly uniform properties is enabled, said pellets being practically spherical in shape and exhibiting a marked green-strength, a high compactness and low plasticity. During subsequent sintering, the pellets provide good bed permeability and the thus sintered pellets exhibit but slight dusting tendencies and a high quality.

The nuclei used in the method according to the invention shall have a strength such that they are fully able to withstand the forces to which they are exposed during a pellet-rolling operation. For example, respective nuclei may have the form of a single piece of crushed rock, optionally rounded, or may have an organic origin, such as sunflower seeds etc. Conveniently, the nuclei may have the form of small bodies or balls of cemented particulate material, or particulate material firmly held together in some other way, cold-bound or sintered balls being preferred. So that the fine, moist material will adhere to the nuclei more readily, the nuclei may be moistened before charging the same to the rolling portion of the rolling circuit.

The pellet-rolling method according to the invention is suitably applied in two or more pellet-rolling circuits, product pellets from one pellet-rolling circuit being used as nuclei in an immediately following pellet-rolling circuit. In this way the extent of pellet growth in each circuit can be held relatively slight, whilst ensuring that the pellet size distribution in one and the same circuit is maintained within a small range. This permits the pellets to be subjected to a powerful mechanical treatment process in the individual circuits, with an increased compactness and green-strength as a result thereof. Optionally, different types or mixtures of moist finely divided material may be used in different circuits, to produce composite pellets having shells of different type materials and/or different composition.

When using a plurality of pellet-rolling circuits connected in series, a slightly larger quantity of product pellets is taken from each circuit than that required as nuclei in a subsequent circuit, the amount or number of pellets for a subsequent pellet-rolling circuit being adjusted by removing product pellets excessive to said amount or number from the immediately preceding pellet-rolling circuit. Although there are obtained in this way pellets which must be disintegrated and returned as nuclei to the first pellet-rolling circuit or as finely divided material to any of said circuits, the ability to control the system is considerably improved, thereby to enable the product pellets formed in the last circuit in line to obtain a size lying within a very small range. The product pellets forming said nuclei are conveniently charged to a subsequent pellet-rolling circuit via a screening device having variable screening openings, the size of the said openings being adjusted so that only that amount or number of product pellets corresponding to a desired amount or number of nuclei is passed through the screening device and charged to said subsequent pellet-rolling circuit. Any pellets of excessively large diameter are separated by said screening device, thereby to further ensure that pellets of uniform size are obtained.

Irrespective of whether one or more pellet-rolling circuits are used, it is an advantage to separate the product pellets from the pellets returned to the rolling portion of the same pellet-rolling circuit by means of a screening device having variable screening openings, the size of the screening openings being varied so that there is obtained a flow of product pellets of a pre-determined, substantially constant value. In this way, the pellet-rolling process can be controlled much more readily.

The pellet growth in each pellet-rolling circuit, and therewith the mean size of the product pellets formed, can be readily adjusted to desired values by adjusting the amount or number of nuclei supplied in relation to the amount of finely-divided material supplied. Conveniently, the adjusted size of the screen openings of the screening device is used as a parameter for controlling the relationship between supply of nuclei and finely divided material.

As previously mentioned, it is advantageous with regard to the mechanical strength of the pellets when the growth of the pellets in the pellet-rolling circuit or each pellet-rolling circuit is relatively slow. A slow growth is furthered when the moist, finely divided material is supplied substantially uniformly distributed over the nuclei and returned pellets located in the pellet-rolling circuit. The effect of the mutual contact between the pellets will also promote pellet strength, particularly when the finely divided material has a relatively low moisture content. Consequently, in accordance therewith a high charge level is suitably maintained.

A preferred embodiment of the invention will now be described with reference to the accompanying drawing, which illustrates schematically an exemplary embodiment of an apparatus for carrying out the pellet-rolling method.

In the drawing, the reference numerals 10, 11 and 12 identify respectively three pellet-rolling circuits, each comprising a respective pellet-rolling drum 13, 14 and 15. Moist iron ore concentrate having a particle size suitable for pellet rolling is supplied to the drum 13 through an inlet 16, to which durable, starting-nuclei for a pellet-rolling operation are also supplied through a further inlet 17. The concentrate, and optionally also the nuclei, is or are substantially uniformly distributed along the drum 13, from the output end of which drum pellets are discharged to a screening device 18 having variable screening openings. By means of the screening device 18 there is separated a predetermined quantity of product pellets, while the remaining pellets discharged from the drum 13 are returned to the drum via a conveying means 19 and the inlet 16. The amount of material conveyed by the conveying means 19 per unit of time is continuously measured and the value obtained is used to adjust the supplied amount of nuclei and concentrate in a manner to maintain said amount of material constant. The desired size of the product pellets is obtained by adjusting in relation to each other the amount of nuclei and concentrate charged to the drum. Similar to the circuit 10, the circuits 11, 12 are provided with respective concentrate inlets 20 and 21, screening devices 22 and 23 with variable screening openings, and conveying devices 24 and 25 for returning screened pellets to respective inlets, a predetermined amount of product pellets discharged from the circuit 11 and 12, respectively, by said screening devices.

Product pellets taken from the circuit 10 are used as nuclei in the circuit 11. The circuit 10 is caused to produce a small surplus of produced pellets, pellets not passed to the circuit 11 being separated out in a screening device 26 having variable screening openings, the thus separated surplus comprising pellets unable to pass through the screening openings of the screening device 26. The amount of material returned by the device 24 is maintained constant by adjusting the amount of product pellets supplied from circuit 10 and the amount of concentrate supplied.

Product pellets from the circuit 11 are used as nuclei in the circuit 12, the circuit 11 being caused to produce a slight surplus of product pellets, of which the largest, to the extent they are not passed to circuit 12, are separated out by a screening device 27 having variable screening openings, in a manner similar to that described with reference to screening device 26. The amount of material returned by the device 25 is maintained constant by adjusting the amount of product pellets supplied from circuit 11 and the amount of concentrate supplied.

The desired size of the product pellets is adjusted for the circuits 11 and 12 by adjusting relationship between the amounts of concentrate and nuclei charged thereto, said nuclei being product pellets obtained from an immediately preceding circuit.

The nuclei supplied to the circuit 10 suitably have a mutually similar diameter within the range 3 - 6 mm, the extent of pellet growth in the circuit 10 being conveniently selected so that the diameter of the product pellets is approximately 2 mm larger than the diameter of the nuclei used. Substantially the same extent of pellet growth can be selected for the circuits 11 and 12.

Although the exemplary embodiment has been described with regard to the manufacture of pellets from iron-ore concentrate, it will be understood that the invention can also be applied in the manufacture of pellets from some other material, including the use of different materials or material mixtures in the different circuits. Similarly, pellet-rolling plates or the like can be used instead of drums. Thus, the invention is not restricted to the illustrated and described embodiment, but can be modified within the scope of the following claims.

We claim:

1. A method of manufacturing pellets from finely-divided moist material, particularly iron one concentrate, by rolling durable nuclei of substantially identical size in at least one pellet-rolling circuit in the presence of said finely-divided moist material, to form pellets having at least one layer of said material surrounding respective nuclei, said circuit including a rolling device and means for returning rolled pellets to said rolling device, wherein a predetermined substantially constant quantity of the pellets formed during a rolling operation, comprising those pellets which during said rolling operation have obtained a diameter larger than a predetermined value, is continuously removed as product pellets from said pellet-rolling circuit, while remaining pellets are returned to the rolling device of the circuit for renewed rolling therein, and wherein the mean size of the product pellets is adjusted to a desired substantially constant value by controlling the amount of nuclei supplied in relation to the amount of finely-divided moist material supplied and by simultaneously maintaining the total amount of material in the pellet-rolling circuit substantially constant.

2. A method according to claim 1, using nuclei formed of single pieces of crushed rock.

3. A method according to claim 1, using nuclei having the form of small spheres of cemented particulate material.

4. A method according to claim 3, using sintered nuclei.

5. A method according to claim 3, using cold-bound nuclei.

6. A method according to claim 1, using moist nuclei.

7. A method according to claim 1, using a plurality of interconnected pellet-rolling circuits to effect pellet-rolling, the product pellets from one of the plurality of pellet-rolling circuits being used as nuclei in an immediately following pellet-rolling circuit.

8. A method according to claim 7, including adjusting the amount of nuclei furnished the immediately following pellet-rolling circuit by removing product pellets excessive to a predetermined amount from an immediately preceding pellet-rolling circuit.

9. A method according to claim 8, using a screening device having variable screening openings for supplying product pellets forming said nuclei to the immediately following pellet-rolling circuit, the screening openings being adjustable so that only that amount of pellets corresponding to the predetermined amount of nuclei passes through said screening device and is supplied to said immediately following pellet-rolling circuit.

10. A method according to claim 14, using a screening device having variable screening openings for separating product pellets from remaining pellets which are returned to the rolling device of the pellet-rolling circuit, the size of said variable screening openings being adjustable so that the flow of product pellets per unit of time is maintained at a predetermined, substantially constant value.

11. A method according to claim 10, including controlling the supply of nuclei by adjusting the size of the screening openings of said screening device.

12. A method according to claim 1, including combining the nuclei, returned pellets and moist material in the rolling device in such manner that the finely-divided moist material is distributed substantially uniformly over the nuclei and returned pellets present in the pellet-rolling circuit.

13. A method of manufacturing pellets from finely-divided moist material, particularly iron ore concentrate, by rolling durable nuclei of substantially identical size in at least one pellet-rolling circuit, in the presence of said finely-divided moist material, to form pellets having at least one layer of said material surrounding respective nuclei comprising:

adding, nuclei and finely-divided moist material to a rolling device of said rolling circuit;

forming rolled pellets by performing a rolling operation in the rolling device whereby the moist material is distributed over the nuclei;

continuously removing rolled pellets from the rolling device;

continuously separating a predetermined substantially constant quantity of pellets having a size larger than a predetermined value from the removed rolled pellets to form product pellets; and returning removed rolled pellets not separated to the rolling device for renewed rolling therein, the mean size of the product pellets being adjusted to a desired substantially constant value by controlling the amount of nuclei supplied in relation to the amount of finely-divided moist material supplied and by simultaneously maintaining the total amount of material in the pellet-rolling circuit substantially constant.

14. A method according to claim 13 using a plurality of interconnected pellet-rolling circuits, the product pellets of one pellet-rolling circuit forming the nuclei for the next succeeding pellet-rolling circuit.

* * * * *